US009494399B2

(12) United States Patent
Paschke et al.

(10) Patent No.: US 9,494,399 B2
(45) Date of Patent: Nov. 15, 2016

(54) ARROW RETAINER

(71) Applicant: LP Archery LLC, Timonium, MD (US)

(72) Inventors: Richard H. Paschke, Timonium, MD (US); William T. Light, Cockeysville, MD (US)

(73) Assignee: Westdale Holdings, Timonium, MD (US)

( * ) Notice: Subject to any disclaimer, the term of this patent is extended or adjusted under 35 U.S.C. 154(b) by 171 days.

(21) Appl. No.: 14/102,839

(22) Filed: Dec. 11, 2013

(65) Prior Publication Data

US 2014/0097101 A1 Apr. 10, 2014

Related U.S. Application Data

(62) Division of application No. 12/775,871, filed on May 7, 2010, now abandoned.

(60) Provisional application No. 61/176,342, filed on May 7, 2009.

(51) Int. Cl.

| | |
|---|---|
| ***B65D 69/00*** | (2006.01) |
| ***B65D 85/00*** | (2006.01) |
| ***F41B 5/06*** | (2006.01) |
| ***F42B 39/26*** | (2006.01) |
| ***A45C 5/03*** | (2006.01) |
| ***A45C 11/00*** | (2006.01) |
| ***F41B 5/14*** | (2006.01) |
| ***F42B 39/00*** | (2006.01) |

(52) U.S. Cl.

CPC ..... *F42B 39/26* (2013.01); *A45C 5/03* (2013.01); *A45C 11/00* (2013.01); *F41B 5/06* (2013.01); *F41B 5/14* (2013.01); *F41B 5/1453* (2013.01); *F41B 5/1457* (2013.01); *F42B 39/007* (2013.01)

(58) Field of Classification Search

CPC ..... F41B 5/06; F41B 5/1453; F41B 5/1457; F42B 39/007

USPC ..... 206/315.1–315.3, 315.11, 443, 523, 206/579; 124/23.1, 25.5, 25.7, 86; 211/60.1; 224/242, 916; 248/127, 146, 248/176.1

See application file for complete search history.

(56) References Cited

U.S. PATENT DOCUMENTS

| | | | | |
|---|---|---|---|---|
| 1,649,245 | A | 11/1927 | McGraw | |
| 2,768,669 | A | 10/1956 | Kinnee | |
| 2,771,620 | A | 11/1956 | Hoffmann | |
| 4,331,287 | A | 5/1982 | Wharton, Jr. | |
| 5,011,028 | A | 4/1991 | Sweeney | |
| 5,137,319 | A * | 8/1992 | Sauder | A01K 97/10 206/315.11 |
| 5,215,070 | A | 6/1993 | Brown | |
| 5,265,584 | A * | 11/1993 | Judson | F41B 5/066 124/25.7 |

(Continued)

*Primary Examiner* — Luan K Bui

(74) *Attorney, Agent, or Firm* — Carter, DeLuca, Farrell & Schmidt, LLP

(57) ABSTRACT

The present disclosure relates to structures that are adapted to facilitate the retention, storage, and transport of arrows. In one embodiment of the present disclosure, for example, an arrow retainer is described that includes a resilient portion having a plurality of passageways extending therethrough for retaining a plurality of arrows therein. Each passageway is resiliently expandable upon insertion of an arrow to maintain the position of the arrow. In another embodiment of the present disclosure, for example, an arrow storage device is disclosed that provides an efficient and secure means of storing arrows. The presently disclosed arrow retainer and arrow storage device may be used in conjunction with one another as part of an arrow storage system.

16 Claims, 9 Drawing Sheets

(56) References Cited

U.S. PATENT DOCUMENTS

| | | | | |
|---|---|---|---|---|
| 5,291,997 | A | 3/1994 | He et al. | |
| 5,358,108 | A | 10/1994 | Celaya | |
| 5,409,109 | A | 4/1995 | Smith | |
| 5,465,887 | A | 11/1995 | Hudson | |
| 5,690,088 | A | 11/1997 | Ruble | |
| 5,803,069 | A * | 9/1998 | Schreiber | F41B 5/063 124/25.7 |
| 6,305,534 | B1 * | 10/2001 | Neal | F41B 5/063 206/315.11 |
| 6,431,162 | B1 * | 8/2002 | Mizek | F41B 5/066 224/916 |
| 6,471,103 | B1 | 10/2002 | Frese et al. | |
| 6,666,204 | B1 * | 12/2003 | Hedrick | F41B 5/066 124/25.5 |
| 6,672,299 | B2 | 1/2004 | Proctor | |
| 6,725,853 | B2 | 4/2004 | Foddrill | |
| 6,814,233 | B2 | 11/2004 | Hammen | |
| 6,880,698 | B2 * | 4/2005 | Fiore, Jr. | A63B 71/0036 206/315.11 |
| 7,152,736 | B1 | 12/2006 | Menichini | |
| 7,367,331 | B1 | 5/2008 | Horinek | |
| 7,942,141 | B1 * | 5/2011 | Love | F41B 5/066 124/25.5 |
| 2003/0140913 | A1 * | 7/2003 | Stinson | F41B 5/066 124/86 |
| 2007/0125670 | A1 | 6/2007 | Lin | |
| 2008/0302346 | A1 * | 12/2008 | Notestine | F41B 5/066 124/25.7 |
| 2010/0300421 | A1 * | 12/2010 | LoRocco | F41B 5/066 124/86 |
| 2012/0103315 | A1 * | 5/2012 | LoRocco | F16B 5/00 124/25.7 |

* cited by examiner

ARROW RETAINER

CROSS-REFERENCE TO RELATED APPLICATIONS

The present application is a divisional application of U.S. patent application Ser. No. 12/775,871, filed on May 7, 2010, abandoned, which claims the benefit of U.S. Provisional Patent Application No. 61/176,342, filed on May 7, 2009, the entire contents of each of which are incorporated herein by reference.

BACKGROUND

1. Technical Field

The present disclosure relates to structures that are adapted to facilitate the retention, storage, and transport of arrows.

2. Background of Related Art

Arrows generally include an elongated shaft having a sharpened tip, or arrowhead, disposed at one end of the shaft, and fletching disposed at the opposite end of the shaft. The shaft may be formed from wood, fiberglass, aluminum alloys, carbon fiber, composite material, or the like, while the arrowhead is typically formed from a hard material, such as metal, for example.

The fletching typically includes several fletches, e.g., feathers or vanes, that are positioned about the shaft. The composition, configuration, positioning and overall aerodynamics of the fletching affects the speed, range, spin, and/or flight path of the arrow. As can be appreciated, even a minor alteration in the shape, or position, of the fletching can have a substantial effect on the flight path of the arrow.

Arrows are customarily stored and transported in arrow tubes, or arrow cases. A typical arrow tube includes a hollow cylindrical body that is configured and dimensioned to receive the arrows, and a replaceable cap. During storage and transport, the arrows may collide with each other, or with the interior of the tube, potentially damaging the fletching. Further, due to movement of the arrows within the tube or case storage and/or transport, arrows of different size, weight, or configuration may no longer be readily distinguishable from each other, particularly where the distinguishing characteristics of the arrows are not visually obvious, such as, for example, where the arrows have different grain weights.

Typical arrow and bow cases generally include one or more placement holders in order to maintain the position and orientation of the arrows within the case. Arrows are typically positioned in alternating orientation, such that the fletching of one arrow does not interfere with the fletching of another. Although the placement holders help prevent damage to the fletching by inhibiting movement the arrows within the case, inserting and removing individual arrows is both tedious and time-consuming. Further, organization of the arrows becomes increasingly complex where arrows of varying size, weight, and/or configuration are used, and since the resiliency, integrity, and/or flexibility of the placement holders may deteriorate over time, they often require replacement.

Larger numbers of arrows than can be accommodated by arrow tubes or cases are typically stored in an arrangement of aligned holes, or in a grid with openings, where the arrows are placed vertically in the holes or openings. While the arrows can be spaced apart to avoid interference with the fletching, this type of mass storage is limited, in that arrows of varying shaft diameter must be accommodated in hole or grid openings that are determined by the largest diameter shaft. In addition, this type of storage cannot accommodate any arrows with tips having dimensions that are larger than the shaft diameter of the arrow, e.g. hunting arrows. In addition, it is difficult to maintain any categorization of arrows, e.g., by grain weight of tips, total grain weight, etc., and known storage devices generally require the alignment of inserted arrows with two concentric holes that are spaced between 10 and 12 inches apart.

SUMMARY

In accordance with one embodiment of the present disclosure, an arrow retainer is provided that is configured and dimensioned for use with an arrow storage device. The arrow retainer includes a resilient member having one or more passageways extending therethrough, wherein the passageways are configured for retaining one or more arrows therein. More particularly, each passageway is resiliently expandable upon insertion of an arrow therethrough such that the passageway retains the arrow in position relative to the resilient member. The resilient member is configured, dimensioned, and adapted for removable positioning within the arrow storage device, whereby a plurality of arrows may be inserted into, and removed from, the arrow storage device simultaneously.

The passageways may be in the form of a slit extending radially through the resilient member. Alternatively, one or more of the passageways may be in the form of an aperture extending longitudinally through the resilient member. Further, the resilient member may include both slits and apertures extending therethrough.

In one embodiment, the apertures extending through the resilient member define two or more different at-rest transverse dimensions for insertion of arrows of differing diameter therethrough.

In another embodiment, the resilient member is made from a foam having a density in the range of about 1.0 pounds per cubic foot to about 3.5 pounds per cubic foot.

In yet another embodiment, the resilient member is made from polyether polyurethane foam.

In still another embodiment, the resilient member defines a cylindrical disc-shaped configuration. The passageways extending through the cylindrical disc-shaped resilient member may be symmetrically positioned about a longitudinal axis of the resilient member.

In still yet another embodiment, the resilient member defines a rectangular cross-sectional configuration. The passageways extending through the rectangular resilient member may be equally spaced with respect to one another along a length of the resilient member.

The configuration and dimensions of the arrow retainer may correspond to those of the arrow storage device, and it is envisioned that the resilient member may be configured and dimensioned for removable positioning within an arrow tube and/or an arrow case.

In another embodiment, one or both of the opposing longitudinal surfaces of the resilient member define a linear configuration. Alternatively, the opposing longitudinal surfaces may define a concave or a convex configuration.

In accordance with another embodiment of the present disclosure, an arrow retainer is provided that is configured and dimensioned for removable reception by an arrow storage device. The arrow retainer includes a cylindrical disc-shaped resilient member defining a longitudinal axis and having a plurality of apertures extending therethrough for retaining a plurality of arrows therein. Each aperture is resiliently expandable upon insertion of an arrow therein such that the resilient member retains the arrows in position relative to the resilient member. The resilient member is adapted for removable positioning within an arrow tube. The resilient member may also include one or more slits extending therethrough for retaining additional arrows therein.

In accordance with still yet another embodiment of the present disclosure, an arrow carrier is provided. The arrow carrier includes one or more resilient members, e.g., two resilient members, as well as a frame.

The resilient members each have a plurality of slits extending therethrough. Each slit is configured for insertion of one or more arrows therethrough, and is resiliently expandable upon insertion of an arrow therethrough such that the arrow is retained in position relative to the resilient member.

The frame includes a base, and first and second side walls, and is adapted for removable positioning within an arrow case. The resilient member(s) is disposed within the frame, and is positioned between the first and second side walls.

It is envisioned that the at least one resilient member may further include a plurality of apertures in communication with the slits, wherein each aperture is configured and dimensioned to retain an arrow therein.

The at least one resilient member may be made from a foam, e.g., a foam having a density in the range of about 1.5 pounds per cubic foot to about 3.5 pounds per cubic foot, or from a polyether polyurethane foam.

In one embodiment, the arrow carrier includes a first resilient member that is positioned adjacent a first end of the frame, and a second resilient member that is positioned adjacent a second end of the frame, wherein first and second resilient members are positioned such that the slits of the first resilient member are in substantial alignment with the slits of the second resilient member.

It is envisioned that the plurality of slits may be equally spaced with respect to one another along a length of the at least one resilient member.

In a final aspect of the present disclosure, an arrow storage system is disclosed that is configured and dimensioned for use with at least one arrow including a shaft having a tip. The arrow storage system includes an arrow stand, and at least one arrow retainer.

The arrow stand includes a shaft having a first end and a second end, a base portion that is secured to the first end of the shaft, and an upper portion that is secured to the second end of the shaft.

The at least one arrow retainer is configured and dimensioned to receive at least one arrow, and may be at least partially formed from a resilient material. The at least one arrow retainer includes at least one aperture extending therethrough, wherein the at least one aperture is configured and dimensioned to removably receive the at least one arrow.

In one embodiment of the arrow storage system, the base portion includes at least one receptacle that is configured and dimensioned to receive the tips of the at least one arrow.

Additionally, it is envisioned that the upper portion may include at least one opening that is configured and dimensioned to receive the at least one arrow, and that the upper portion may be at least partially formed from a resilient material. In such embodiments, the opening may be configured and dimensioned as a longitudinal slit that is normally biased towards a closed position.

These and other features of the presently disclosed subject matter will become more readily apparent to those skilled in the art through reference to the detailed description of the various embodiments provided below.

BRIEF DESCRIPTION OF THE DRAWINGS

Various embodiments of the presently disclosed arrow retainer are described herein with reference to the drawings wherein.

DETAILED DESCRIPTION

Figure 1A:
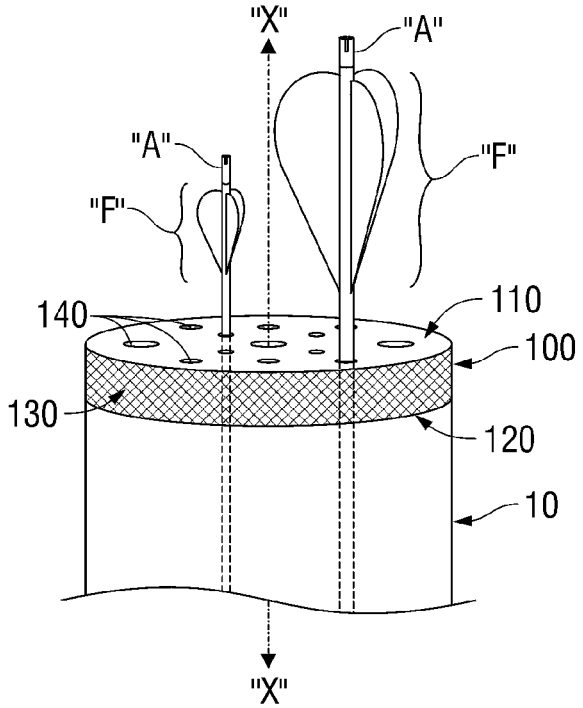
FIGS. 1A and 1B are top, perspective views of an arrow retainer in accordance with one embodiment of the present disclosure positioned within a storage device, and having a plurality of arrows inserted therethrough.
Figure 1B:
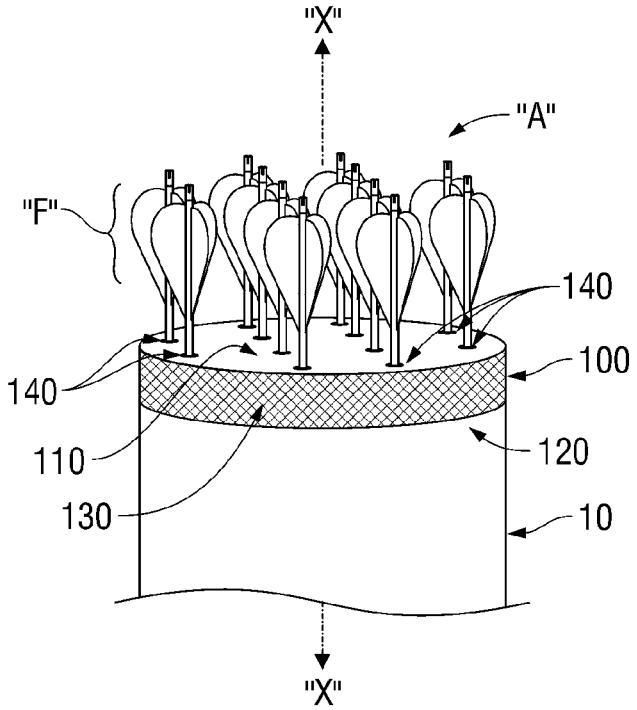
Figure 1C:
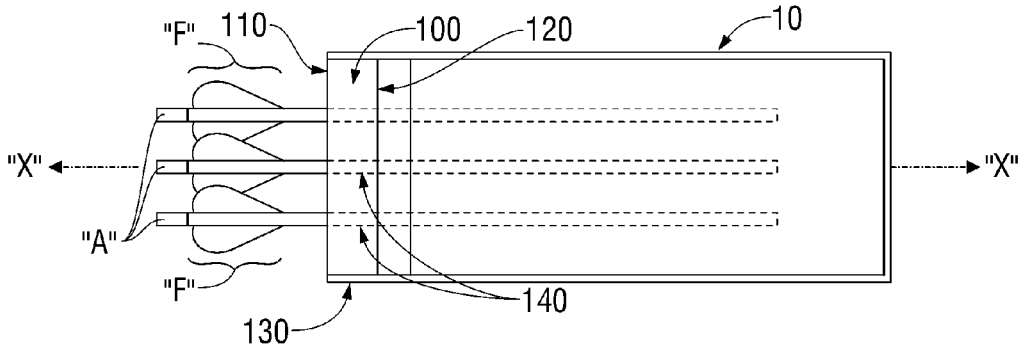
FIG. 1C is a side view of the arrow retainer and arrow tube seen in FIGS. 1A and 1B FIGS. 2A-2C are side, cross-sectional views illustrating alternative configurations for the arrow retainer of FIG. 1A.

Turning now to FIGS. 1A-1C, an arrow retainer in accordance with one embodiment of the present disclosure is shown, and generally identified by reference numeral 100. The presently disclosed arrow retainer 100, and the variations thereof described herein below, are configured, dimensioned, and adapted for use with those structures that are used in the storage and/or transport of arrows, which are collectively referred to as "storage devices" throughout the following description. For example, in FIGS. 1A-1C, arrow retainer 100 is shown disposed within a storage device that is configured as an arrow tube 10. It should be appreciated, however, that, in alternative embodiments, arrow retainer 100 may be adapted for use with any other suitable storage device, such as, for example, an arrow case 20 (see FIGS. 12A, 12B), an arrow carrier 900 (FIG. 10), an arrow stand 400 (FIGS. 6-8), an arrow storage system 800 (FIG. 9), or the like, without departing from the scope of the present disclosure. Further, it is envisioned that arrow retainer 100 may be either integrally form with, or removably from, the storage device, e.g., the arrow tube 10 shown in FIGS. 1A-1C, such that arrow retainer 100 may be transferred between different storage devices. Allowing for removal of arrow retainer 100 from the storage device is advantageous in that arrows "A" (see FIGS. 1A-1C) need not be transferred individually, thereby allowing for a more efficient transition, and maintenance of any categorization of arrows "A" (see FIGS. 1A-1C), such as by grain weight of the arrow tips, the total weight of the arrow, or by FOC (Front of Center) position.

With continued reference to FIGS. 1A-1C, arrow retainer 100 corresponds generally to the configuration and dimensions of the storage device with which it is employed. In the embodiment of arrow retainer 100 illustrated in FIGS. 1A-1C, for example, arrow retainer 100 is illustrated in connection with arrow tube 10, which has a substantially cylindrical configuration. Consequently, arrow retainer 100 is illustrated as defining a substantially cylindrical, or puck-like, configuration in FIGS. 1A-1C. However, as will be discussed in further detail below, alternative configurations for arrow retainer 100 are also contemplated herein.

Arrow retainer 100 includes an upper surface 110, a lower surface 120, and an outer peripheral surface 130, and defines a longitudinal axis "X." As will be described in greater detail herein below, arrow retainer 100 includes a plurality of passageways, e.g., apertures 140, extending longitudinally therethrough, each of which is configured to retain a portion of an arrow "A" therein. As can be appreciated, apertures 140 are positioned such that fletching "F" of arrows "A" are sufficiently spaced-apart from one another when disposed through arrow retainer 100, such that fletching "F" are substantially undisturbed during insertion, removal, transport, and/or storage of arrows "A." Further, as will be described below, arrow retainer 100 may be adapted to retain a plurality of arrows "A" having different characteristics, e.g., arrows "A" of varying sizes, weights, fletch configurations, etc., while allowing for efficient insertion, removal, transport, and/or storage of arrows "A."

It is envisioned that arrow retainer 100 be formed from a resiliently compressible material to absorb impact forces that may occur during insertion, removal, storage, and/or transport of arrows "A" to thereby inhibit damage to arrows "A," and more particularly, to inhibit damage to the fletching "F." Suitable materials for the construction of arrow retainer 100 include, but are not limited to, resiliently compressible elastomers and foams. More particularly, suitable materials may include, but are not limited to, resiliently compressible foams having densities in the range of about 1.0 pounds per cubic foot to about 3.5 pounds per cubic foot, such as, for example, polyether polyurethane foam. However, other materials may be employed in the fabrication of arrow retainer 100 without departing from the scope of the present disclosure.

Various embodiments and configurations of the presently disclosed arrow retainer will now be described. Each embodiment of the presently disclosed arrow retainer described herein below is substantially similar to arrow retainer 100, and consequently, in the interests of brevity, will only be discussed with respect to any differences therefrom.

Figure 2A:
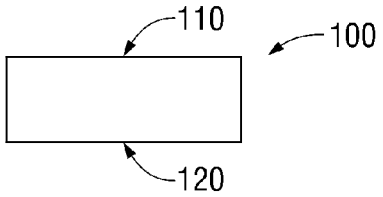
Figure 2B:
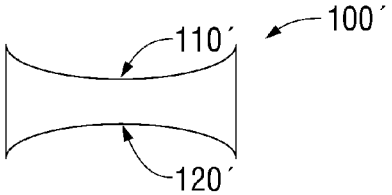
Figure 2C:
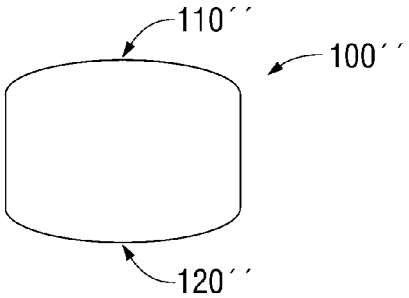

As shown in FIG. 2A, arrow retainer 100 may define a substantially rectangular cross-sectional configuration, i.e., wherein upper surface 110 is substantially parallel to lower surface 120 of arrow retainer 100. Alternatively, as shown in the embodiments of FIGS. 2B and 2C, arrow retainers 100' and 100", respectively, may define respective concave upper and lower surfaces 110', 120' (FIG. 2B), or may define convex upper and lower surfaces 110", 120", respectively (FIG. 2C). The specific configuration of arrow retainer 100 may also be varied dependent upon the particular configurations and dimensions of the arrows "A" (see FIGS. 1A-1C) to be used therewith.

Figure 3A:
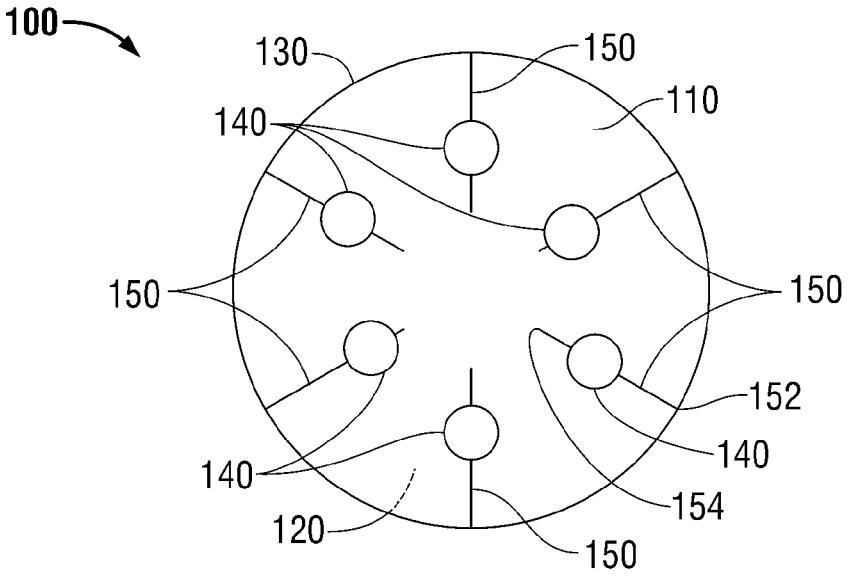
FIG. 3A is a top view of an alternative embodiment of the presently disclosed arrow retainer including a plurality of slits and a plurality of apertures extending therethrough.
Figure 3B:
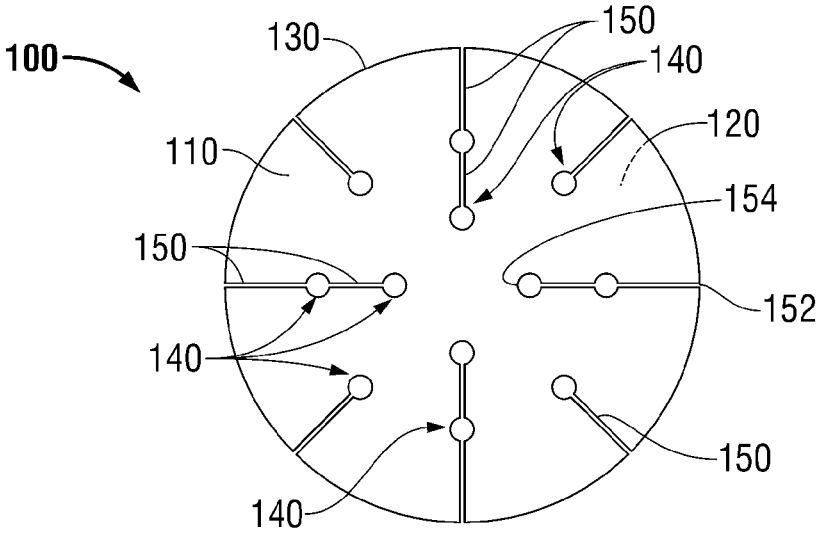
FIG. 3B is a top view of illustrating an alternate configuration for the arrow retainer shown in FIG. 3A.

With reference now to FIGS. 3A-3B, arrow retainer 100 is shown including a plurality of passageways extending therethrough, e.g., apertures, or arrow parks, 140, and slits 150. In the specific embodiment of arrow retainer illustrated in FIG. 3A, arrow retainer 100 is depicted as including six (6) apertures 140, and six (6) slits 150 that are positioned radially about arrow retainer 100. However, embodiments of arrow retainer 100 including greater and fewer numbers of apertures 140 and slits 150 are also contemplated herein. For example, in the embodiment illustrated in FIG. 3B, arrow retainer 100 is illustrated as including twelve (12) apertures 140 and eight (8) slits 150.

With continued reference to FIGS. 3A-3B, slits 150 extend longitudinally through arrow retainer 100, i.e., through upper surface 110 and lower surface 120 thereof (FIG. 1A). Each slit 150 is biased closed due to the resiliency of the material comprising arrow retainer 100. Each slit 150 further includes a first end 152 that is positioned adjacent outer peripheral surface 130 of arrow retainer 100, and extends radially inward to second ends 154 that are positioned adjacent the center of arrow retainer 100.

Each aperture 140 is in communication with one of the slits 150, and is biased radially inward due to the resiliency of the material comprising arrow retainer 100. As can be appreciated through reference to FIGS. 3A and 3B, each aperture 140 defines a transverse dimension, e.g., a diameter, that is greater than the transverse dimension of slits 150, such that an arrow "A" (see FIGS. 1A-1C) may be positioned, or "parked," within each aperture 140. As shown in FIG. 3B, apertures 140 may be disposed along the same slit 150, such that apertures 140 are in communication with one another. Due to the communication between the apertures 140 and slits 150, upon insertion of arrows "A" (see FIGS. 1A-1C), arrows "A" may be moved between apertures 140 and slits 150, e.g., along the length of slit from first end 152 to second end 154, and into a desired position, such as within one of apertures 140, for example. Additionally, the inclusion of slits 150 that are in communication with apertures 140 adapts arrow retainer 100 for use with arrows having tips that are larger than the arrow shafts, e.g. hunting arrows (not shown), broadheads (not shown), and fishing arrows (not shown). Specifically, upon the insertion of such arrows "A" through slits 150, given the configuration and dimensions of slits 150, slits 150 can expand to accommodate the larger dimensions of the tips. Thereafter, the arrows "A" can be slid into apertures 140 to retain the position of arrows "A," which would allows slits 150 to close under the bias provided by the resilient material comprising arrow retainer 100.

Although slits 150 and apertures 140 illustrated as being arranged in symmetrical fashion in the embodiments of arrow retainer 100 shown in FIGS. 3A and 3B, asymmetrical configurations are also contemplated. Further, while apertures 140 are illustrated as defining equivalent transverse dimensions in FIGS. 3A-3B for retaining arrows "A" of equal, or similar, dimensions, as will be described in detail below, in alternative embodiments, it is envisioned that arrow retainer 100 may include multiple sets of apertures 140 incorporating varying transverse dimensions for retaining arrows "A" of different sizes.

Often times, arrows "A" are inserted into arrow retainer 100 when arrow retainer 100 is positioned outside of the storage device, e.g., the arrow tube 10 illustrated in FIGS. 1A-1C. In this circumstance, when arrow retainer 100 is utilized with arrows "A" having tips that are lager than the diameter of the arrow shafts, e.g., broadheads, the arrows "A" are inserted into the slits 150 and moved along the slit into the apertures 140. The loaded arrow retainers 100 are then placed into the storage device, and the loaded arrow retainers 100 are positioned so that no part of the arrows "A" extends outside of the storage device.

Referring now to FIGS. 3A and 3B, in conjunction with FIGS. 1A-1C, in use, an arrow "A" is inserted through one of slits 150, and is moved into engagement with one of apertures 140 until the arrow "A" is positioned as illustrated in FIG. 1B. In this position, only a portion of arrow "A," e.g., the fletching "F,"" extends from upper surface 110 of arrow retainer 100. However, no portion of arrow "A" will extend beyond the storage device, e.g., the arrow carrier 10 shown in FIGS. 1A-1C. Due to the resiliency of the material comprising arrow retainer 100, arrow retainer 100 is compressed, i.e., slits 150 and/or apertures 140 are enlarged, in order to accommodate the insertion of an arrow "A." Accordingly, apertures 140 may define an at-rest transverse dimension, e.g., diameter, that is less than (or equal to) the diameter of arrows "A," such that apertures 140 are expanded during passage of arrows "A" therethrough. Due to this expansion, slits 150 and/or apertures 140 apply a force to arrows "A" that is directed radially inward, whereby arrows "A" are retained in a substantially fixed position within arrow retainer 100.

The resiliency of the material comprising arrow retainer 100 also helps protect the arrows "A" and, more particularly, the arrow fletching "F," from damage during insertion, removal, storage, and/or transportation. Arrow retainer 100 maintains arrows "A" in a substantially fixed, spaced-apart position such that, for example, contact between adjacent arrows "A" and/or arrow tube 10 is substantially limited, if not completely prevented, during insertion, removal, storage and/or transportation. Further, apertures 140 and slits 150 are sufficiently-spaced from one another to inhibit contact between, and thus substantially reduce the likelihood of damage to, the fletching of arrows "A", even where arrows "A" are displaced in response to significant forces acting on arrow retainer 100, e.g., where arrow tube 10 is dropped or abruptly shifted. Additionally, It is contemplated that arrows "A" inserted into retainer 100 may be rotated to minimize any interference between fletching "F" of adjacent arrows or the inner wall of the arrow tube.

Figure 4:
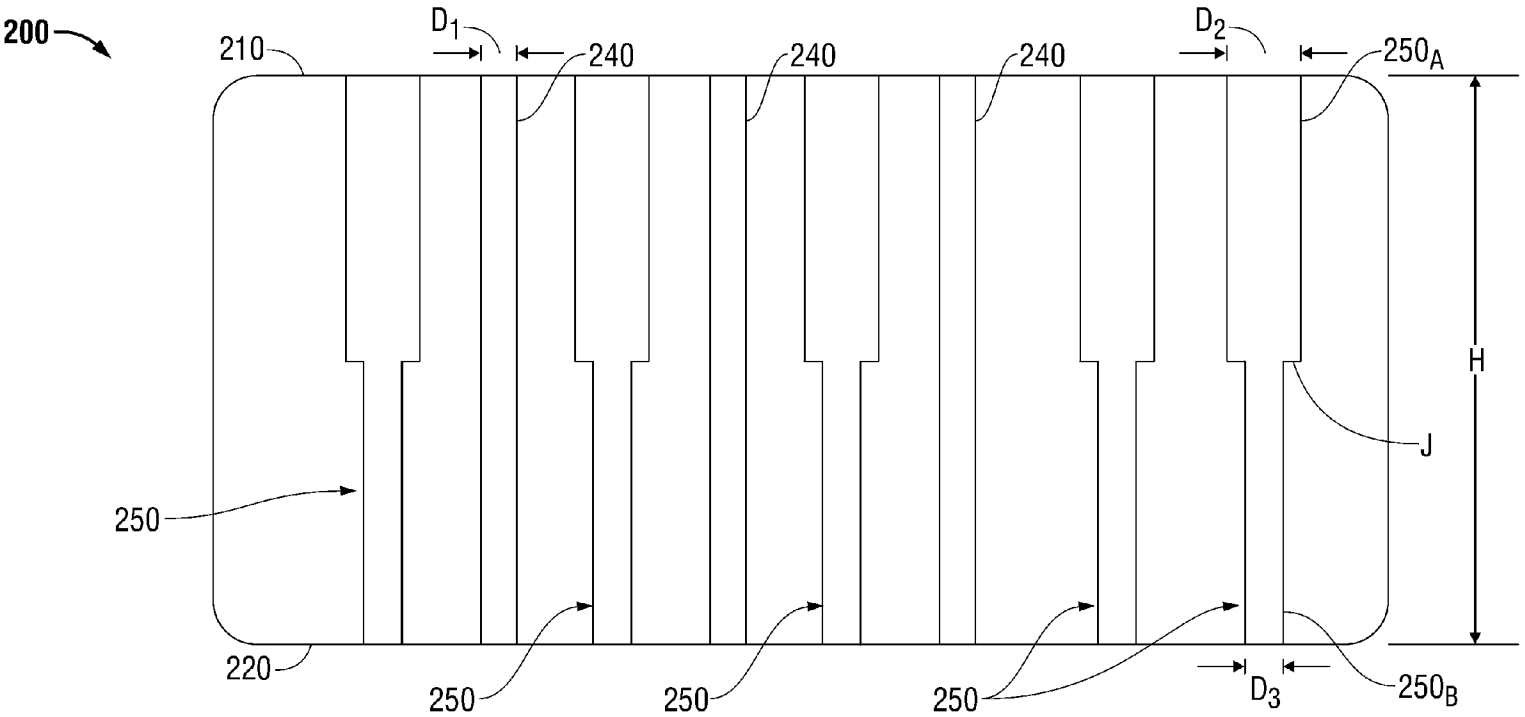
FIG. 4 is a side, cross-sectional view of still another embodiment of the presently disclosed arrow retainer including one set of apertures having a substantially constant transverse dimension along a longitudinal dimension of the arrow retainer, and another set of apertures having a transverse dimension that varies along the longitudinal dimension of the arrow retainer.

Turning now to FIG. 4, another embodiment of the presently disclosed arrow retainer, which is identified by the reference character 200, will be described. Arrow retainer 200 includes respective upper and lower surfaces 210, 220, and has a height "H" that is defined by the distance between the respective upper and lower surfaces 210, 220. In the particular embodiment shown in FIG. 4, arrow retainer 200 is shown as including one set of apertures 240, and one set of apertures 250, which may be arranged in any desired configuration, e.g., in symmetrical or asymmetrical patterns.

Whereas apertures 240 define an at-rest transverse dimension $D_1$, e.g., a diameter, that is constant along the height "H" of arrow retainer 200, the transverse dimension of apertures 250 varies along the height "H" of arrow retainer 200. For example, as seen in FIG. 4, apertures 250 include an upper portion $\mathbf{250}_A$ extending from upper surface 210 towards lower surface 220, and a lower portion $\mathbf{250}_B$ extending from lower surface 220 towards upper surface 210. Upper and lower portions $\mathbf{250}_A$, $\mathbf{250}_B$ are arranged in concentric fashion, and meet at juncture "J." Upper portion $\mathbf{250}_A$ defines a transverse dimension $D_2$, and lower portion $\mathbf{250}_B$ defines a transverse dimension $D_3$, wherein $D_2$ is illustrated as being larger than $D_3$. It is envisioned that the transverse dimension $D_3$ of the lower portion $\mathbf{250}_B$ of apertures 250 may be less than, greater than, or equal to the transverse dimension $D_1$ of apertures 240, which would facilitate placement of a larger number of smaller diameter arrows "A" in the arrow retainer 200.

In the embodiment of arrow retainer 200 illustrated in FIG. 4, apertures 240 are configured and dimensioned to receive arrows "A" having shafts that are smaller in diameter than those that may be inserted into apertures 250.

As discussed above with respect to arrow retainer 100 (see FIGS. 3A-3B), the resilient material comprising arrow retainer 200 retains arrows "A" (see FIGS. 1A-1C) in position within aperture 240 and/or apertures 250. By including apertures 250 that are capable of receiving arrows with larger diameter shafts, and apertures 240 that are capable of receiving arrows with smaller diameter shafts, the utility of arrow retainer 100 is maximized, in that damage to arrow retainer 200 and/or arrows "A" that may otherwise occur with known devices can be avoided. Specifically, with known devices including uniform apertures, i.e., apertures each having an identical transverse dimension, smaller diameter arrows "A" may be allowed to move within the apertures following insertion, thereby creating the potentiality for damage to the fletching, e.g., the fletching "F" included on arrows "A" seen in FIG. 1A. Additionally, with respect to larger diameter arrows "A," the arrows "A" may undergo damage as they are forced through the apertures, and/or may cause damage to the device itself, e.g., by irreparably expanding the apertures, detrimentally impacting the resiliency and/or life of the device, etc.

Figure 5:
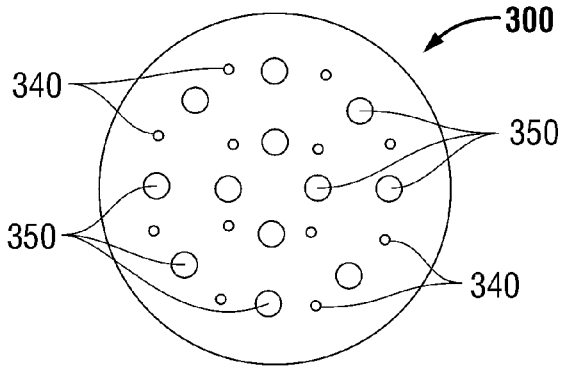
FIG. 5 is a top view of yet another embodiment of the presently disclosed arrow retainer including a plurality of apertures arranged symmetrically.

FIG. 5 shows another embodiment of the presently disclosed arrow retainer, which is identified by the reference character 300. Arrow retainer 300 includes two sets of apertures 340, 350 arranged in a symmetrical pattern. Each of the two sets of apertures 340 and 350 have different diameters for accepting arrows "A" (see FIGS. 1A-1C) of varying diameter therethrough. As in the previous embodiments, such a configuration protects the arrows "A" (see FIGS. 1A-1C) and, more particularly, the arrow fletching "F" (see FIGS. 1A-1C), from damage during insertion, removal, storage and/or transportation.

While several embodiments and configurations of arrow retainers of the present disclosure are shown in FIGS. 3A-5 and discussed above, it is envisioned that the arrow retainers may include various other configurations including greater or fewer apertures, apertures of different sizes, and/or apertures positioned in different symmetrical or asymmetrical patterns.

Figure 6:
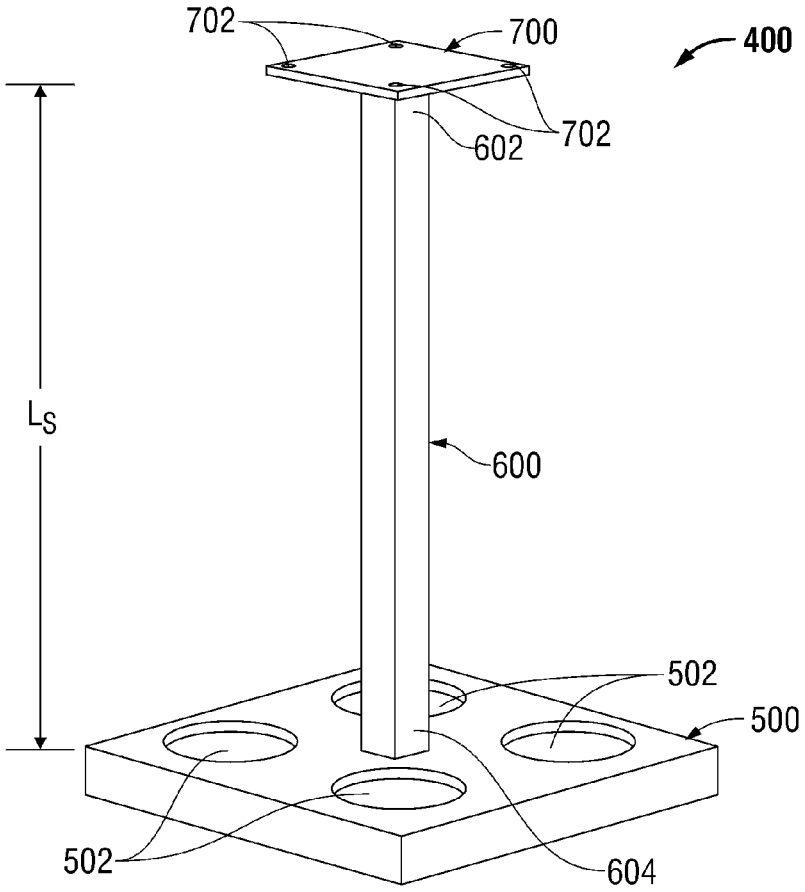
FIG. 6 is a top perspective view of an arrow stand according to the principles of the present disclosure.
Figure 7:
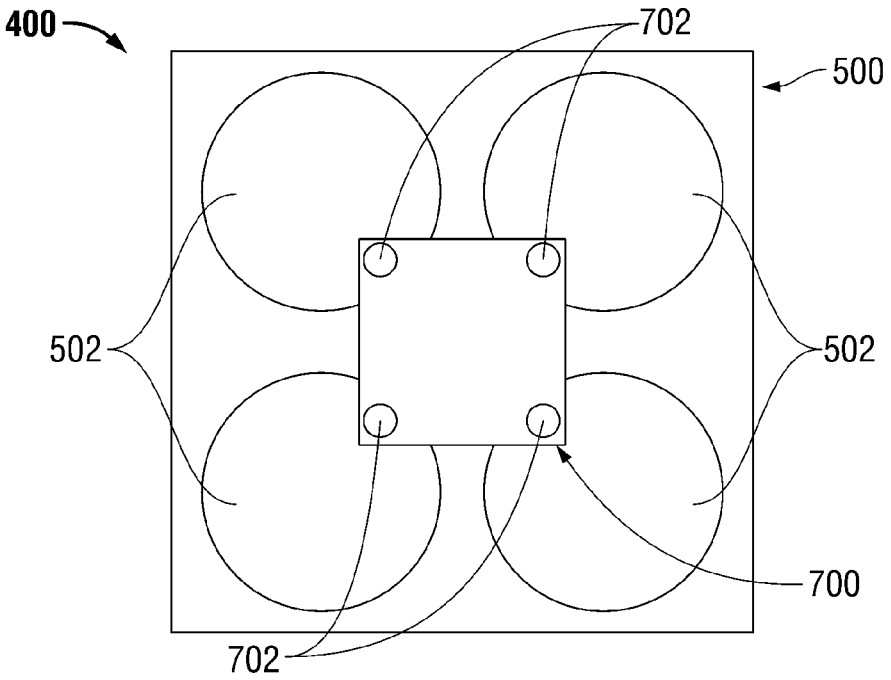
FIG. 7 is a top view of the arrow stand shown in FIG. 6.
Figure 8:
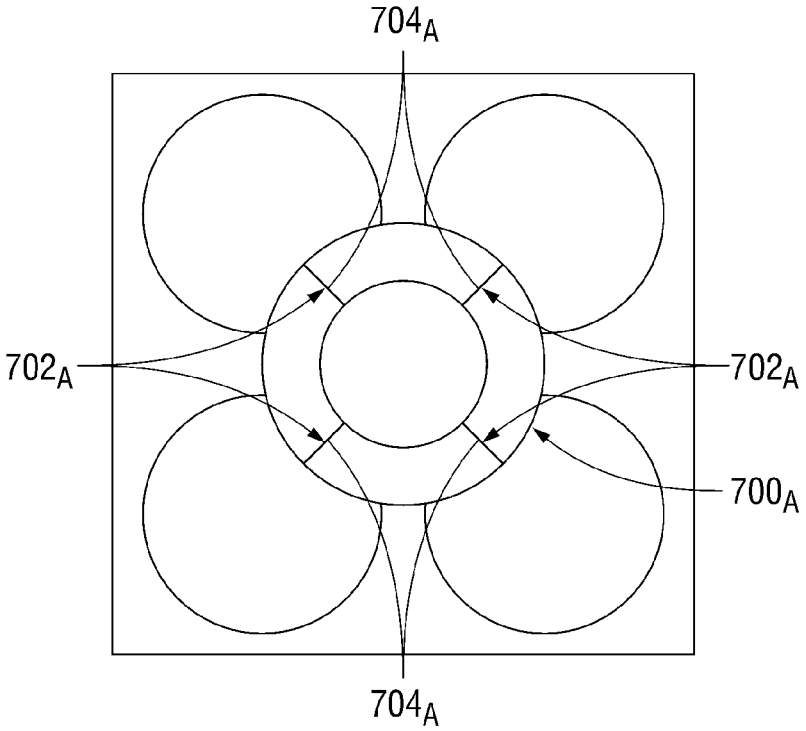
FIG. 8 is a top view of an alternative embodiment of the arrow stand shown in FIG. 6.

Referring now to FIGS. 6-8, various embodiments of a storage device according to the principles of the present disclosure will be described. With reference to FIGS. 6 and 7 in particular, the presently disclosed storage device is configured as an arrow stand 400. Arrow stand 400 provides an easy and efficient means of storing and transporting a multitude of arrows "A" (FIGS. 1A-1C), and includes a base portion 500, a shaft 600, and an upper member 700. Unless indicated otherwise, each component of arrow stand 400 may be formed from any suitable material, including but not limited to, wood, polymeric materials, and various metals.

Base portion 500 is configured and dimensioned to provide a stable platform that maintains arrow stand 400 in the upright position illustrated in FIG. 6, and may assume any suitable geometric configuration, e.g., square, circular, etc. Base portion 500 includes a plurality of receptacles 502 that are configured and dimensioned to receive the tips of arrows "A" (see FIG. 9). In the particular embodiment of arrow stand 400 shown in FIG. 6, base portion 500 is illustrated as including four (4) receptacles 502. However, in alternative embodiments of arrow stand 400, it is contemplated that base portion 500 may include either greater or fewer numbers of receptacles 502.

Shaft 600 may assume any suitable geometric configuration, e.g., tubular, rectangular, etc., and defines a length "$L_S$" that extends between respective upper and lower ends 602, 604 of shaft 600. In general, the length "$L_S$" of shaft 600 will be typically equal to between 50% and 75% of the length of the arrows "A" (FIGS. 1A-1C, 9) intended for use with arrow stand 400. For example, it is contemplated that "$L_S$" may be approximately equal to 24 inches.

Upper and lower ends 602, 604 of shaft 600 are securely fixed to upper member 700 and base portion 500, respectively, and may be fixed thereto in any suitable manner. For example, shaft 600 may be either releasably or integrally formed with the upper member 700 and base portion 500, e.g., through the use of adhesives, screws, via an interference fit, or the like.

Upper member 700 of arrow stand 400 includes at least one opening 702 that is configured and dimensioned to receive the shaft of at least one arrow "A" (FIGS. 1A-1C, 9), In the particular embodiment of arrow stand 400 shown in FIG. 6, upper member 700 is illustrated as including four (4) openings 702, i.e., it is envisioned that the number of openings 702 formed in upper member 700 may correspond to the number of receptacles 502 formed in base portion 500. In alternative embodiments of arrow stand 400, it should be appreciated, however, that upper member 700 may include either greater or fewer numbers of openings 702, or that the number of openings 702 formed in upper member 700 and the number of receptacles 502 formed base portion 500 may be different. While openings 702 are illustrated as having a substantially circular configuration in FIG. 7, openings 702 may assume any suitable geometric configuration, e.g., square, star-shaped, etc.

With reference now to FIG. 8, an alternative embodiment of upper member, which is identified by reference character $\mathbf{700}_A$, will be described. Upper member $\mathbf{700}_A$ is substantially similar to upper member 700, and consequently, in the interests of brevity, will only be discussed with respect to any differences therefrom.

Upper member $\mathbf{700}_A$ is at least partially formed from a resilient material, and includes at least one opening $\mathbf{702}_A$ extending therethrough that is configured and dimensioned to receive the shaft of at least one arrow "A" (FIGS. 1A-1C, 9), In the particular embodiment illustrated in FIG. 8, upper member $\mathbf{700}_A$ is illustrated as including four (4) opening(s) $\mathbf{702}_A$ that are configured as slits $\mathbf{704}_A$. However, in alternative embodiments, upper member $\mathbf{700}_A$ may include greater or fewer numbers of openings $\mathbf{702}_A$, and/or openings $\mathbf{702}_A$ having other configurations, e.g., openings that are substantially elliptical or circular.

Figure 9:
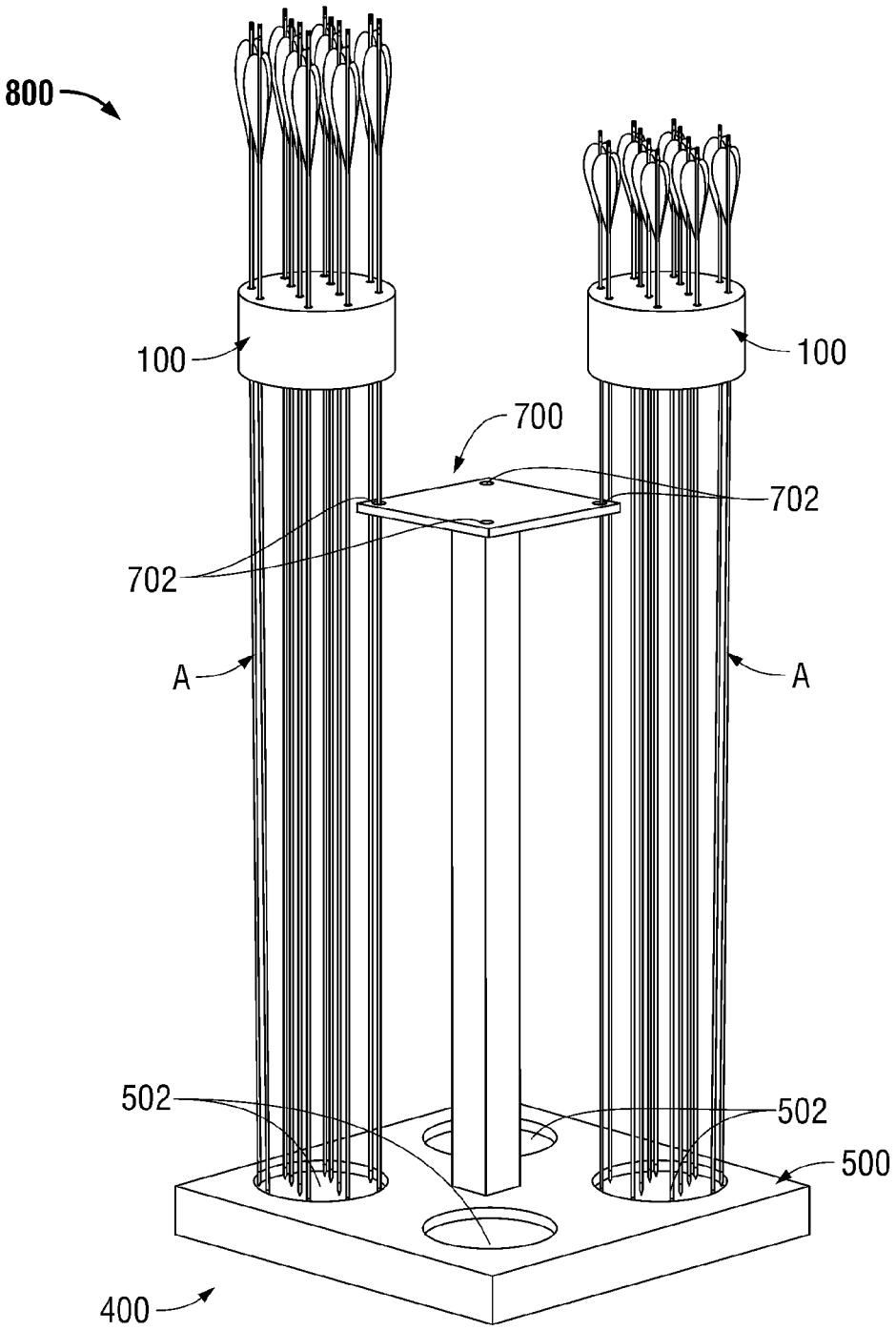
FIG. 9 is a top perspective view of an arrow storage system according to the principles of the present disclosure, and including the arrow stand illustrated in FIG. 6, as well as a pair of the presently disclosed arrow retainers.

With reference now to FIG. 9, an arrow storage system 800 is disclosed. Arrow storage system 800 includes the arrow stand 400 described above with respect to FIGS. 6 and 7, and one or more arrow retainers, e.g., arrow retainer 100, which was discussed above with respect to FIGS. 1A-1C. In the particular embodiment shown in FIG. 9, arrow storage system 800 is illustrated as including two (2) arrow retainers 100. It should be understood, however, that in alternative embodiments, arrow storage system 800 may include greater or fewer numbers of arrow retainers 100 dependent upon the particular number of arrows "A" to be stored and/or transported. Additionally, it should be appreciated that arrow retainer 100 may be replaced by any of the alternative embodiments described herein, and that the various embodiments of the presently disclosed arrow retainer may be utilized in combination with each other. For example, arrow storage system 800 may include one arrow retainer 100 (FIGS. 1A-1C), for example, and one arrow retainer 200 FIG. 4).

During use of arrow storage system 800, arrows "A" are inserted into arrow retainers 100 in accordance with the discussion provided above with respect to FIGS. 1A-1C. In the embodiment of arrow storage system 800 illustrated in FIG. 9, twelve (12) arrows are accommodated by each arrow retainer 100, to thereby define two separate clusters of arrows "A." However, dependent upon the particular configurations and dimensions of arrow retainer 100 and arrow stand 400, arrow storage system 800 may be adapted to accommodate a far greater number of arrows "A."

Following the insertion of arrows "A" into retainers 100, one or more arrows "A" from each cluster is inserted into one of the openings 702 formed in the upper member 700, such that one or more arrows "A" from each cluster extends through upper member 700. The tips of arrows "A" are then positioned within receptacles 502 formed in base portion 500 to fix the position of arrows "A" relative to stand 400.

By utilizing arrow retainers 100 to arrange arrows "A" into clusters, and by employing various embodiments of the presently disclosed arrow retainer, the user can arrange and categorize arrows "A" in any desired manner. For example, the user can arrange arrows "A" having particular grain weights into different clusters, or the user can arrange different clusters for hunting arrows (not shown), broadhead arrows (not shown), or fishing arrows (not shown).

Figure 10:
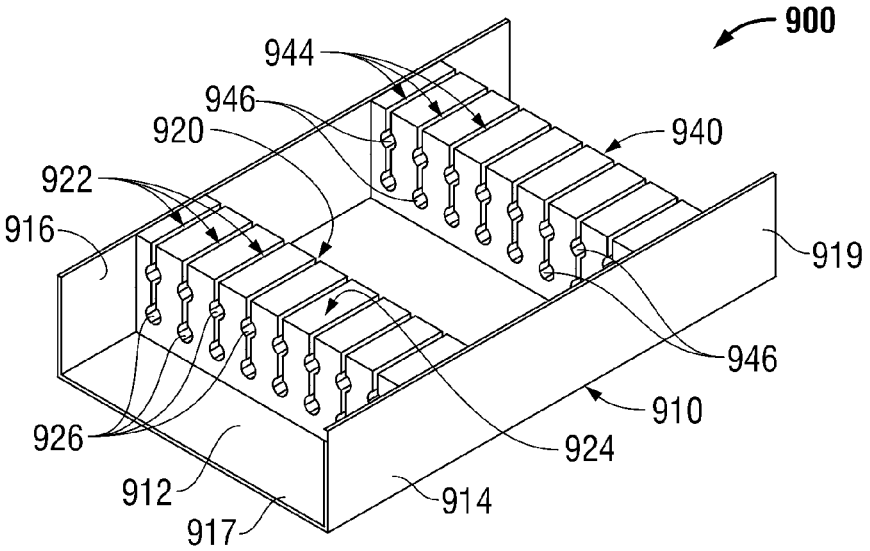
FIG. 10 is a side, perspective view of an arrow carrier in accordance with one embodiment of the present disclosure, and including a pair of arrow retainers therein.

Turning now to FIG. 10, an arrow carrier is shown generally identified by reference numeral 900. Arrow carrier 900 includes a frame 910 with a base 912, and a pair of opposed side walls 914, 916. First and second arrow retainers 920, 940 are positioned within arrow carrier 900. More specifically, first arrow retainer 920 is disposed between side walls 914, 916 adjacent a first end 917 of arrow carrier 900, while arrow retainer 940 is disposed between side walls 914, 916 adjacent a second end 919 of arrow carrier 900. It is also envisioned that arrow retainers 920, 940 may be positioned closer or further from one another, and/or that additional arrow retainers similar to arrow retainers 920, 940 may be positioned within arrow carrier 900. It is further envisioned that arrow carrier 900 may be formed from a substantially rigid material, such that frame 910 retains arrow retains 920, 940 in position therein.

Additionally, it is envisioned that arrow retainers 920, 940, as with arrow retainer 100 discussed above, may be formed from a resiliently compressible material such as resiliently compressible foams having densities in the range of about 1.5 pounds per cubic foot to about 3.5 pounds per cubic foot, e.g., polyether polyurethane foam, although other suitable materials are also contemplated.

Arrow retainers 920, 940 are substantially similar, and are oriented similarly with respect to one another, such that arrows "A" (see FIGS. 1A-1C) may be inserted through each of arrow retainers 920, 940. Each of arrow retainers 920, 940 defines a generally rectangular configuration, and includes a plurality of slits 922, 942 extending from the top surfaces 924, 944 thereof, respectively, toward base 912 of frame 910. Slits 922, 942 may be equally spaced along arrow retainers 920, 940, respectively, or may be positioned in any other suitable spaced-apart fashion, such that arrows "A" (see FIGS. 1A-1C) disposed within adjacent slits 924, 944 do not interfere with, or contact, one another.

With continued reference to FIG. 10, slits 922 of arrow retainer 920, and slits 942 of arrow retainer 940 each define an open end at top surfaces 924, 944 of arrow retainers 920, 940, respectively. Accordingly, arrows "A" (see FIGS. 1A-1C) may be inserted through slits 922, 942 from top surfaces 924, 944 of arrow retainers 920, 940, respectively, and advanced into position. Each slit 922, 942 further includes one or more apertures 926, 946 defined therein for retaining, or "parking," an arrow "A" (see FIGS. 1A-1C). Thus, upon insertion of arrows "A" (see FIGS. 1A-1C) through slits 922, 942, arrows "A" (see FIGS. 1A-1C) may be advanced into position within one of apertures 926, 946, respectively. Each aperture 926, 946 defines a diameter greater transverse dimension, e.g., diameter, that that of slits 922, 942, respectively, such that an arrow "A" (see FIGS. 1A-1C) may be fixedly positioned, or "parked," within each of apertures 926, 946. Upon insertion of arrows "A" (see FIGS. 1A-1C), each arrow "A" (see FIGS. 1A-1C) is retained within arrow carrier 900 by arrow retainer 920 at a first end thereof, and by arrow retainer 940 at a second end thereof.

Figure 11:
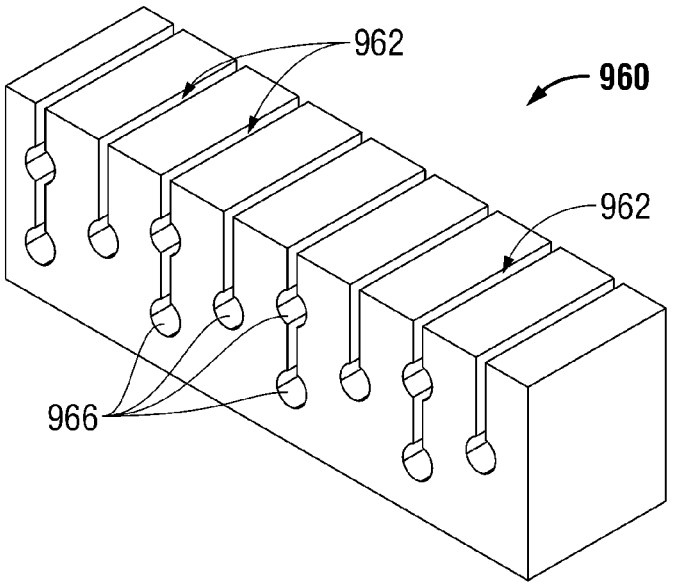
FIG. 11 is an isolated, perspective view of another embodiment of the presently disclosed arrow retainer that is configured for use with the arrow carrier of FIG. 10.

FIG. 11 shows another embodiment of an arrow retainer identified by the reference character 960, that is configured for use with arrow carrier 900. Arrow retainer 960 is similar to arrow retainers 920, 940 (see FIG. 10) except for the configuration of slits 962 and apertures 966. It is envisioned that the arrow retainers, e.g., arrow retainers 920, 940, 960, may define any suitable configuration permitting arrows "A" (see FIGS. 1A-1C) to be positioned therein in a spaced-apart relation to inhibit interference with, or damage to arrows "A" during insertion, removal, storage and/or transportation.

Figure 12A:
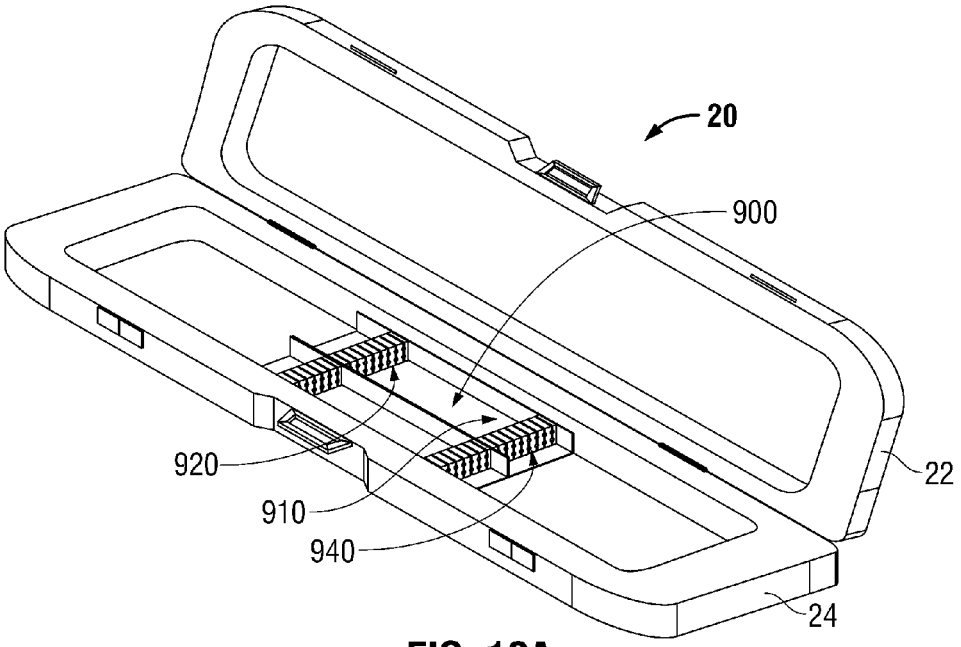
FIG. 12A is a side, perspective view of an arrow case shown with the arrow carrier of FIG. 10 positioned therein.
Figure 12B:
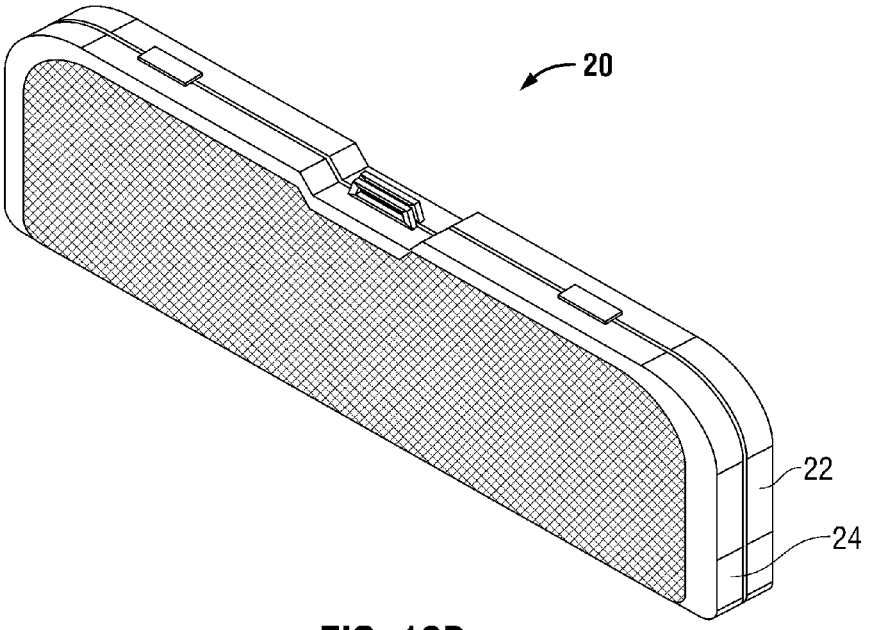
FIG. 12B is a side, perspective view of the arrow case of FIG. 12A shown in a closed position.

Turning now to FIGS. 12A and 12B, in conjunction with FIG. 10, an arrow case 20 will be described that is configured for transporting arrows "A" (see FIGS. 1A-1C). Arrow case 20 generally includes top and bottom housing sections 22, 24, respectively, that are hingedly connected to facilitate movement of arrow case 20 between an open position (FIG. 12A) and a closed position (FIG. 12B). One (or both) of the housing sections, e.g., housing section 24, may include a releasable engagement mechanism(s) (not explicitly shown), e.g., snaps, buttons, clips, or other releasable fasteners such as VELCRO® fasteners. A complementary releasable fastener(s) (not explicitly shown) may be disposed on a bottom surface of base 912 of arrow carrier 900 such that arrow carrier 900 may be releasably engaged within arrow case 20, as shown in FIG. 12A. As can be appreciated, such a configuration allows arrow carrier 900 to be transferred between different arrow storage and/or transport devices, e.g., arrow case 20, without the need to transfer the arrows "A" (see FIGS. 1A-1C) individually, thereby allowing for a more efficient transition between carriers, and a reduction in the likelihood that any categorization of arrows "A" will be disrupted (see FIGS. 1A-1C) during movement between carriers. It is anticipated that the carrier 900 may also be positioned within a bow case.

The above description, disclosure, and figures should not be construed as limiting, but merely as exemplary of particular embodiments. It is to be understood, therefore, that the disclosure is not limited to the precise embodiments described, and that various other changes and modifications may be effected by one skilled in the art without departing from the scope or spirit of the present disclosure. Additionally, persons skilled in the art will appreciate that the features illustrated or described in connection with one embodiment may be combined with those of another, and that such modifications and variations are also intended to be included within the scope of the present disclosure. Therefore, the above description should not be construed as limiting, but merely as exemplifications of particular embodiments. Those skilled in the art will envision other modifications within the scope and spirit of the claims appended hereto.

What is claimed is:

1. An arrow storage system configured to retain a plurality of arrows, each arrow including an arrow shaft having a tip end and a fletch end, the arrow storage system comprising:
- a resilient arrow retainer defining a plurality of passageways extending therethrough, a first portion of the arrow shaft of each of the plurality of arrows removably received within one of the passageways;
- an arrow stand, including:
  - a stand shaft having a first end and a second end;
  - a base portion secured to the first end of the stand shaft, the base portion including a receptacle configured to removably receive the tip end of each of the plurality of arrows; and
  - an upper member secured to the second end of the stand shaft, the upper member including an opening configured to removably receive a second portion of the arrow shaft of a predetermined number of the plurality of arrows; and
- a portable arrow storage device, wherein the resilient arrow retainer is removably positionable within the portable arrow storage device.

2. The arrow storage system according to claim 1, wherein the predetermined number is equal to the total number of arrows in the plurality of arrows.

3. The arrow storage system according to claim 1, wherein the predetermined number is equal to one.

4. The arrow storage system according to claim 1, wherein the plurality of passageways of the resilient arrow retainer include at least one slit extending longitudinally through the resilient arrow retainer.

5. The arrow storage system according to claim 1, wherein the plurality of passageways of the resilient arrow retainer include at least one aperture extending longitudinally through the resilient arrow retainer.

6. The arrow storage system according to claim 1, wherein the plurality of passageways of the resilient arrow retainer include at least one slit and at least one aperture extending longitudinally through the resilient arrow retainer.

7. The arrow storage system according to claim 1, wherein the plurality of passageways of the resilient arrow retainer include a plurality of apertures extending longitudinally through the resilient arrow retainer, at least two of the apertures defining different at-rest transverse dimensions.

8. The arrow storage system according to claim 1, wherein the resilient arrow retainer defines a cylindrical disc-shaped configuration.

9. The arrow storage system according to claim 8, wherein the plurality of passageways of the resilient arrow retainer are symmetrically positioned about a longitudinal axis of the resilient arrow retainer.

10. The arrow storage system according to claim 8, wherein the plurality of passageways of the resilient arrow retainer include a plurality of apertures extending longitudinally through the resilient arrow retainer, at least one of the apertures including an upper portion with a first transverse dimension, and a lower portion with a second, different transverse dimension, the upper and lower portions being substantially concentric.

11. The arrow storage system according to claim 1, wherein the resilient arrow retainer defines a rectangular cross-sectional configuration.

12. The arrow storage system according to claim 1, wherein at least one surface of the resilient arrow retainer defines a concave configuration.

13. The arrow storage system according to claim 1, wherein the upper member of the arrow stand is at least partially formed from a resilient material.

14. The arrow storage system according to claim 13, wherein the opening of the upper member of the arrow stand is configured as a longitudinal slit defined through the upper member.

15. The arrow storage system according to claim 1, wherein the stand shaft of the arrow stand defines a length in a range of between 50% and 75% of a length of each of the plurality of arrows.

16. An arrow storage system configured to retain first and second pluralities of arrows, each arrow including an arrow shaft having a tip end and a fletch end, the arrow storage system comprising:

a first resilient arrow retainer defining a plurality of passageways extending therethrough, a first portion of the arrow shaft of each of the first plurality of arrows removably received within one of the passageways;

a second resilient arrow retainer defining a plurality of passageways extending therethrough, a first portion of an arrow shaft of each of the second plurality of arrows removably received within one of the passageways; and an arrow stand, including:

a stand shaft having a first end and a second end;

a base portion secured to the first end of the stand shaft, the base portion including a first receptacle configured to removably receive the tip end of each of the first plurality of arrows and a second receptacle configured to removably receive a tip end of each of the second plurality of arrows; and an upper member secured to the second end of the stand shaft, the upper member including an opening configured to removably receive a second portion of the arrow shaft of a predetermined number of the first plurality of arrows and a second opening configured to removably receive a second portion of the arrow shaft of a predetermined number of the second plurality of arrows.

* * * * *